United States Patent [19]

Whalen, Jr.

[11] 3,972,629

[45] Aug. 3, 1976

[54] MARKING DEVICES

[76] Inventor: John J. Whalen, Jr., 63 Maple Place, Amityville, N.Y. 11701

[22] Filed: June 3, 1975

[21] Appl. No.: 583,471

[52] U.S. Cl. ..... 401/199; 47/38.1

[51] Int. Cl.[2] ..... B43K 5/00; B43K 7/00

[58] Field of Search ..... 47/38.1, 38; 401/198, 401/199, 223, 224, 209–217; 239/63; 73/337

[56] References Cited

UNITED STATES PATENTS

| | | | |
|---|---|---|---|
| 2,593,599 | 4/1952 | Patch | 401/199 |
| 3,032,802 | 5/1962 | Kusama | 401/199 X |
| 3,113,336 | 12/1963 | Langnickel | 401/199 X |
| 3,133,307 | 5/1964 | Steinberg et al. | 401/199 |

FOREIGN PATENTS OR APPLICATIONS

| | | | |
|---|---|---|---|
| 717,617 | 10/1966 | Italy | 401/199 |

*Primary Examiner*—Lawrence Charles

[57] ABSTRACT

An improved marking device consisting of an absorbent reservoir, an absorbent wick, means for maintaining the concentration of marking fluid in the wick at a preset level and a writing tip, in contact with said wick for applying a marking fluid.

10 Claims, 7 Drawing Figures

MARKING DEVICES

BACKGROUND OF THE INVENTION

The invention relates generally to marking devices and more specifically to markers having a marking fluid reservoir of absorbent material. Such devices generally consist of an absorbent reservoir, a fibrous, absorbent writing tip and a holder, supporting the writing tip in contact with the reservoir. The reservoir usually contains a voltatile marking fluid or ink (interchangeable terms). Markers of this type are made with a variety of marking tip shapes and ink shades. Narrow, "fine-line", writing tips are used as fountain pens for longhand writing, drawing, and applying cosmetics. Wider tips with dark ink shades may be used for package labelling and various forms of artwork. Wider tips in combination with pastel inks (yellow, pink, etc.) are used by students for "highlighting." "Highlighting" consists of covering an important word, sentence or paragraph with a coating of pastel ink to make it stand out, or emphasize it. A recent modification of this basic design is the rolling-ball type marker where a wick is used to transport marking fluid from a reservoir to a rotatably mounted ball.

The vast majority of such markers are designed to be filled with ink just once at the factory. When the ink supply runs out the marker is discarded. A problem with such single-filling markers is that the concentration of ink in the reservoir varies from a maximum at the time of purchase to a minimum when the pen is discarded. As a result the concentration of ink in the marking tips, and the amount or density of ink applied to the writing surface also vary during the life of the marker. When a newly purchased marker is used, a very heavy, dense ink coating will be applied. This will sometimes soak through the page, or leave "puddles" or smudges at the end of a line. For an intermediate period a desired amount of ink will be applied. But then as the ink supply is depleted the marker will leave a coating which is undesirably thin or faint. Similar problems can result with markers used for other purposes. Presently available markers have no means to prevent the density of ink application from varying along with changes in the ink concentration in their reservoir during the life of the markers.

SUMMARY OF THE INVENTION

The invention provides means for automatically controlling the flow of marking fluid from an absorbent reservoir to a marking tip in such a way that the tip applies a constant density mark throughout the life of the marker. This is achieved by maintaining a fixed, predetermined concentration of marking fluid in an abosorbent wick. A portion of the wick may serve as absorbent actual marking tip or a separate tip may be placed in contact with the wick. Flow control means maintain this predetermined concentration as follows: If the ink concentration in the wick falls below the predetermined concentration, the control means allows marking fluid to flow from the reservoir to the wick. If the concentration of fluid in the wick rises above the predetermined level ink flow from reservoir to wick is prevented.

The control means included a component, formed of a material whose dimensions change with changes in its moisture content. This component is placed in communication with the wick so that marking fluid may diffuse freely from wick to the component and vice versa. Changes in the concentration of marking fluid in the wick or component, cause similar changes in the concentration of fluid in the component or wick respectively. For example, if the concentration of fluid in the wick were to fall, fluid would diffuse from the component into the wick causing the concentration in the component to fall also. Since the dimensions of the component are moisture dependent changes in the fluid concentration in the wick will result in dimensional changes in the component. These dimensional changes are then used to control the transport of fluid from the reservoir to the wick.

The wick and component are initially placed in contact and filled with marking fluid until the wick contains the predetermined concentration. The concentration in the component will depend on the relative hygroscopic attraction of wick and component. The component will expand to dimensions dependent on its moisture content. The marker is then assembled. Any fall in ink concentration in the wick (as by use) will cause the component to decrease its dimension. This dimensional change is used to actuate the control means to permit fluid flow from an absorbent ink-filled reservoir to the wick. When the predetermined concentration in the wick is again achieved the component expands to its initial dimensions and further flow is prevented.

Three basic arrangements are disclosed for using dimensional changes in the component as a means for controlling fluid flow from reservoir to wick. One uses the linear dimension change of the component directly to close or open a fluid transport "circuit" in between the reservoir and wick. A second includes an elongate actuator made up of the component bound to a thin, flexible moisture insensitive strip. The actuator tends to flex in one direction or the other in response to increases or decreases in the fluid concentration in the component. This flexure is used to open or close a fluid transport circuit between the reservoir and the wick. In a third arrangement the component is placed adjacent to a transport member. An increase in the fluid concentration in the wick causes the component to swell and thereby exert compressional force on the transport member which prevents marking fluid flow therethrough. While specific geometric arrangements are disclosed numerous alternatives are considered obvious in view of the disclosure and these arrangements are shown merely for example.

Numerous natural and synthetic materials are available for use as the moisture sensitive component. Many of these have been used for moisture meters or hygrometers. Specific materials which may be used include wood, (U.S. Pat. Nos. 2,164,434; 2,157,685; 2,134,067; 3,512,712) cellulose acetate (U.S. Pat. No. 2,093,797), material from the seed pods of particular plants (U.S. Pat. Nos. 3,135,117; 3,688,579), tree bark (U.S. Pat. No. 3,204,872) silica gel (U.S. Pat. No. 3,306,108) and various cellulose derivatives (U.S. Pat. Nos. 3,279,255; 3,368,755; 3,461,723).

The wick may be used as the basis of constant ink supply in marking devices in various ways. The wick itself may be used as the applicator, or separate applicator element may be placed in contact with the wick, the applicator may be an absorbent, fiber-type tip or a ball made of hard porous or non-porous material.

The invention will be more clearly understood and further advantages will be apparent from the following detailed description which taken in conjunction with the drawings shows specific embodiments of the invention.

DETAILED DESCRIPTION OF THE INVENTION

Figure 1:
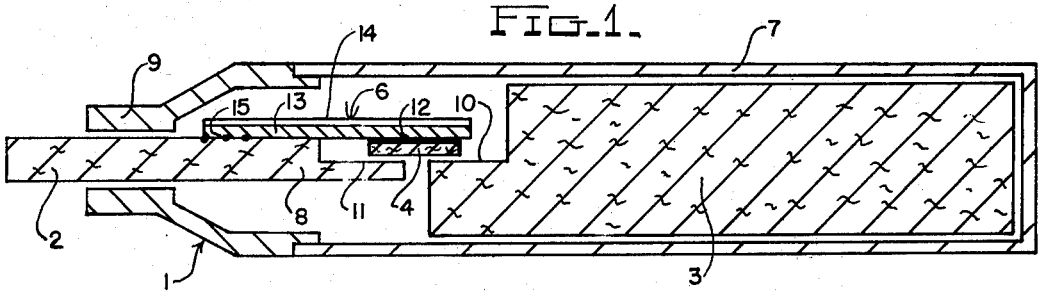
FIG. 1 shows a longitudinal cross-sectional view of a first embodiment of the invention.
Figure 2:
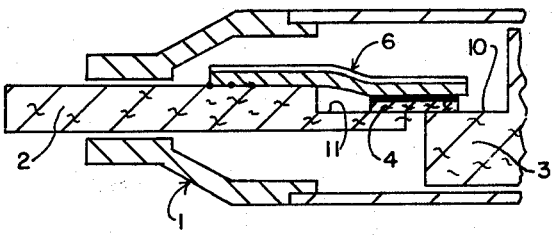
FIG. 2 shows a longitudinal, cross-sectional view of the marking tip end of the device of FIG. 1.

FIG. 1 shows a first embodiment of the invention. Marker 1 comprises a marking tip 2, a reservoir 3, transport member 4, actuator 6 and holder 7. The tip, reservoir and transport member are all made of any fibrous absorbent material in common use in markers today. Tip 2 is provided with an elongate extension 8 and is held firmly by tip support portion 9 of holder 7. Reservoir 3 contains marking fluid and has a planar surface 10 which is parallel with the top planar surface 11 of extension 8. Transport member 4 as shown in FIG. 2 can rest flush on top of surfaces 10 and 11 and is capable of allowing marking fluid to diffuse from reservoir 3 into tip 2. It is fastened to and isolated from actuator 6 by means of shield 12 which is impermeable to marking fluid. Actuator 6 has two components. The first component 13 is made of a material whose dimension is very sensitive to moisture changes. Any of the materials previously described may be used. Component 14 is a thin flexible element made of a material which shows little dimensional change with changes in moisture. The actuator is firmly fixed to the top of tip 2 by glue spots 15. Marker 1 is assembled as follows: Component 13 (with member 4 attached) is first fastened to tip 2. The tip is then filled with fluid to a predetermined level and fluid equilibrium between tip 2 and component 13 allowed to occur. Flexible component 14 is then bound to component 13. Reservoir 3 is saturated with fluid and placed with surface 10 in proximity of transport member 4. Operation is as follows: When the marker is used the concentration of marking fluid in tip 2 and component 13 decreases. This causes component 13 to shrink and composite actuator 6 to flex downward as, shown in FIG. 2, bringing transport member 4 in contact with surfaces 10 and 11. Marking fluid now flows from reservoir 3 to tip 2 and component 13 via member 4. Eventually tip 2 and component 13 have their initial fluid level replenished, component 13 expands and actuator 6 returns to its original position. Further fluid flow from reservoir 3 to tip 2 is prevented. As can be seen, the actuator causes fluid to flow from reservoir to tip whenever the concentration in the tip falls below a predetermined level, maintaining that level throughout the marker. of the emarker.

Figure 3:
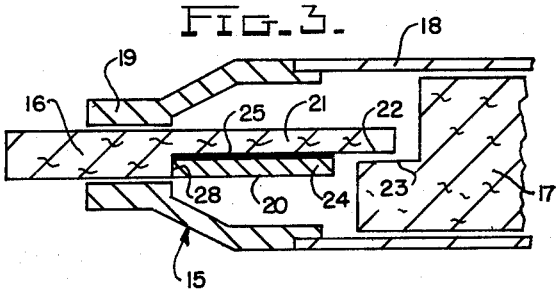
FIGS. 3, 4, 5 and 7 similar views of a second, third, fourth and fifth embodiments of the invention.

FIG. 3 shows a marker which is simpler but in many ways resembles marker 1. Marker 15 comprises a tip 16; reservoir 17, holder 18, with tip support 19; and actuator 20. Tip 16 has an elongate extension 21 which serves as a transfer member, and a surface 22 which is adapted to make and break contact with surface 23. Actuator 20 consists of moisture sensitive component 24 and thin, flexible impermeable component 25. Component 24 is in intimate contact with tip 16 at 28 and fluid may diffuse readily between the two. Manufacturer and operation are in principle the same as in marker 1. At manufacture tip 16 is filled with a desired quantity of fluid and placed in contact with component 24. When equilibrium occurs components 24 and 25, and transport member 21 are bonded together. Any decrease in fluid concentration in 16 causes a similar decrease in component 24. This causes it to shrink flexing member 21 downward and pulling surface 22 into contact with surface 23. Fluid diffuses from 17 through 21 and returns 16 to its original fluid concentration.

Figure 4:
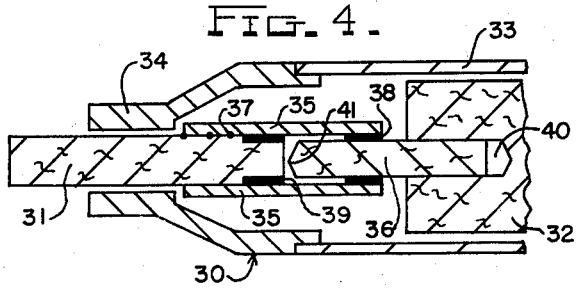

FIG. 4 shows the marking tip end of a third embodiment of the invention. Marker 30 is comprised of tip 31, reservoir 32 holder 33 with tip support 34 actuators 35 and transport member 36. Actuators 35 are made of material which tends to expand in response to the absorption of moisture. They are fixed rigidly to tip 31 via glue spots 37 and to transport member 36 via impermeable shields 38. Shields 39 are also impermeable and are fixed to tip 31. Actuator 35 may slide freely over shield 39. Transport member 36 may slide freely in and out of cavity 40 in reservoir 32 while maintaining sliding contact with the cavity walls. the distal end of 36 is provided with an obtuse taper 41. At manufacture tip 31 is filled with the desired ink concentration and actuators 35 are attached as shown. Actuators are allowed to absorb ink until they reach equilibrium. Member 36 is placed into cavity 40 and both reservoir 32 and member 36 are saturated with ink. 36 is then moved out of cavity 40 until the point of taper 41 is just shy of contacting tip 31. Actuators 35 are then fastened to member 36 via shields 38. With use the ink concentration in tip 31 and actuators 35 will fall causing actuators 35 to shrink, pulling 36 into contact with 31 and allowing ink to flow from reservoir 32 to tip 31.

Figure 5:
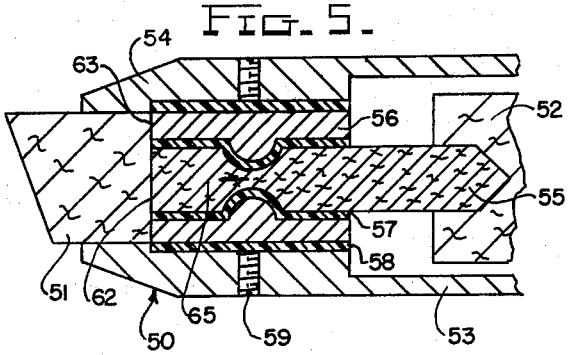
Figure 6:
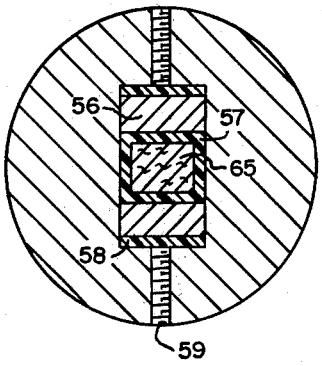
FIG. 6 shows a transverse, cross-sectional view of the device of FIG. 5.

FIG. 5 and 6 show a fourth embodiment of the invention. Marker 50 is comprised of a marking tip 51, reservoir 52, holder 53, tip support 54, transport member 55 and actuators 56. Parts 51, 52 and 53 are all made of abosrbent materials. Member 55 is in intimate contact with tip 51 and 62 and reservoir 52 is capable of transmitting marking fluid from 52 to 51. It has a narrow neck portion 65. Actuators 56 are made of material that expand upon absorption of moisture. They are in intimate contact with tip 51 at surface 63. They have protuberances 10 which match the shape of neck portion 65 and are separated from transport member 55 by shield 57. Plates 58 contact the outer surface of actuators 56. Set screws 59 may be tightened to apply a variable force to actuators 56 via plates 58. At manufacture tip 51 and member 55 are connected to each other and filled with the desired marking fluid concentration. Screws 59 are tightened and neck portion 65 compressed to the point that fluid does not flow through the neck portion. Reservoir 52 is then saturated with fluid and brought in contact with member 55. With use the concentration of marking fluid in tip 51 and actuators 56 will decrease. Actuators 56 will shrink somewhat reducing the pressure on neck-portion 65. This will allow fluid to flow from reservoir 52 to tip 51 via member 55. When the fluid concentration in 51 and 56 again reach the preset level 56 will expand shutting off further flow through 55.

Figure 7:
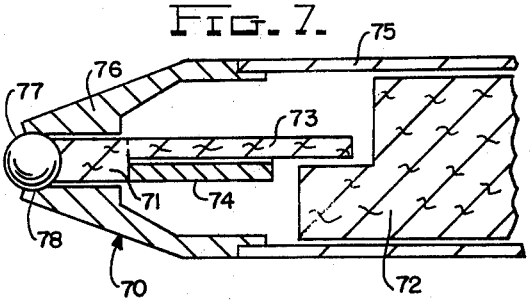

While all of the above embodiments show the invention as it applies to fiber tipped markers it can be readily incorporated into other marking devices. Several manufacturers have recently introduced a marker comprising an absorbent reservoir, a ball, rotatably mounted, for applying ink, and a wick for transmitting ink from the reservoir to the ball (Pentel Spree). FIG. 7 shows the marking tip end of such a marker modified in view of the invention.

The marker 70 of FIG. 7 comprises a wick 71, reservoir 72, transport member 73, actuator 74, holder 75, ball support 76 and ball 77. Ball support 76 is provided with cavity 78 in the form of a spherical section which supports ball 77 and holds it and wick 71 in snug contact. The operation of the device is the same as device 15 in FIG. 4. The desirable feature is that the ink concentration in the wick remains constant and hence the ink supplied to the surface marked via the ball 77 remains constant. Ball 77 may be made of non-porous metal which will pick up marking fluid by simple contact with wick 71, or of hard porous material that can absorb fluid from wick 71.

While the invention has been described and illustrated with respect to certain preferred examples it will be understood by those skilled in the art that numerous changes and modifications may be made without departing from the spirit of the invention.

What is claimed is:

1. A marking device comprising:

a. an absorbent reservoir containing a marking fluid;

b. an absorbent wick;

c. applicator means for applying said fluid; and d. control means for automatically regulating the flow of marking fluid from said reservoir to said wick, comprising an actuator, a component of which is made of a material whose dimensions are a function of moisture content, said component and said wick being in fluid communication, so that marking fluid may flow therebetween and so that changes in the fluid concentration in said wick results in changes in the fluid concentration in and the dimensions of said component, whereby a decrease in the fluid concentration in said wick below a predetermined level causes fluid to flow from said reservoir to said wick to return the fluid concentration in said wick to said predetermined level.

2. A marking device as in claim 1 wherein; a decrease in the fluid concentration in said wick below said predetermined level results in dimensional changes in said component which cause fluid to move from said reservoir to said wick tending to return the fluid concentration in said wick to said predetermined level.

3. A marking device as in claim 2 further comprising a transport member and wherein a fall in fluid concentration in said wick below said predetermined levels, and resultant dimensional changes in said component permits fluid to move from said reservoir to said wick via said transport member.

4. A marking device as in claim 3 wherein:

a. said component and said actuator are elongate and flex in a first or second direction in response to increases and decreases respectively in the fluid concentration in said wick and;

b. said flexion places said transport member in fluid communication with at least one of said wick and said reservoir when the fluid concentration in said wick falls below said predetermined levels.

5. A marking device as in claim 3 wherein:

a. said component changes its linear dimensions in response to changes in fluid concentration in said wick and;

b. said linear dimensional changes places said transport member in fluid communication with at least one of said wick and said reservoir when the fluid concentration in said wick falls below said predetermined level.

6. A marking device as in claim 3 wherein, a. the transport member is made of absorbent material and is in fluid communication with said wick and said reservoir;

b. said component changes its linear dimensions in response to changes in fluid concentration in said wick;

c. said component is placed adjacent to said transport member and applies a compressional force thereto;

d. said compressional force is a function of the fluid concentration in said wick;

e. said compressional force prevents fluid movement from reservoir to said wick when the fluid concentration in said wick is at or above said predetermined level and permits movement when said concentration falls below said predetermined level.

7. A marking device as in claim 2 wherein the applicator comprises a surface of said wick.

8. A marking device as in claim 2 wherein the applicator comprises an absorbent marking tip in fluid communication with said wick.

9. A marking device as in claim 2 wherein the applicator comprises a rotatably mounted ball in fluid communication with said wick.

10. A marking device comprising:

a. an absorbent reservoir containing a marker fluid;

b. an absorbent wick containing a predetermined concentration of said marking fluid;

c. an actuator made of a material whose dimensions are a function of its moisture content, said actuator and said wick being in fluid communication so that said marking fluid may freely diffuse therebetween whereby changes in the fluid concentration in said wick results in changes in the fluid concentration in and the dimensions of said actuator; and d. transport means capable of transporting marking fluid from said reservoir to said wick; and e. wherein a fall in the concentration of marking fluid in said wick below said predetermined concentration results in dimensional changes in said actuator which cause marking fluid to move from said reservoir to said wick via said transport means and return the concentration of marking fluid in said wick to said predetermined concentration.

* * * * *